United States Patent [19]

Paterson

[11] Patent Number: 4,789,450

[45] Date of Patent: Dec. 6, 1988

[54] ELECTROLYTIC CELL

[75] Inventor: Malcolm R. Paterson, Nedlands, Australia

[73] Assignee: Bateman Engineering (International) Limited, Boksburg North, South Africa

[21] Appl. No.: 942,287

[22] Filed: Dec. 16, 1986

[51] Int. Cl.[4] ..... C25C 7/02; C25D 17/06; C25D 17/10

[52] U.S. Cl. ..... 204/269; 204/275; 204/279; 204/284; 204/287; 204/288

[58] Field of Search ..... 204/269, 275, 286, 287, 204/288, 284, 212, 297 R, 279

[56] References Cited

U.S. PATENT DOCUMENTS

| | | | |
|---|---|---|---|
| 2,398,059 | 4/1946 | Turner | 204/297 R |
| 2,529,237 | 11/1950 | Turner et al. | 204/284 X |
| 2,792,342 | 5/1957 | Tuwiner | 204/284 X |
| 2,975,120 | 3/1961 | Kenmore et al. | 204/287 X |
| 3,161,578 | 12/1964 | Facquet et al. | 204/212 |
| 3,450,622 | 6/1969 | Cothran | 204/275 X |
| 4,059,493 | 11/1977 | Rice | 204/287 X |
| 4,197,181 | 4/1980 | Portal | 204/287 X |
| 4,399,020 | 8/1983 | Branchick et al. | 204/275 X |
| 4,680,100 | 7/1987 | Morin | 204/284 X |

FOREIGN PATENT DOCUMENTS

| | | | |
|---|---|---|---|
| 1171568 | 8/1987 | U.S.S.R. | 204/212 |

*Primary Examiner*—Donald R. Valentine

*Attorney, Agent, or Firm*—Dennison, Meserole, Pollack & Scheiner

[57] ABSTRACT

The present invention relates to an electrolytic cell for use in electrowinning metal values from solutions containing same, which comprises a housing arranged to contain solution to be subjected to electrolysis, anode means, cathode means, inlet means for feeding fresh solution into the housing and outlet means for removing treated solution from the cell, wherein the cathode means comprises an assembly which contains material upon which electrowon metal values are deposited and which assembly is arranged to be removed from the cell for removal of the material bearing deposited metal values and replacement by fresh material, and subsequent return of the cathode assembly to the cell.

11 Claims, 4 Drawing Sheets

ELECTROLYTIC CELL

The present invention relates to an electrolytic cell. In accordance with one aspect of the present invention there is provided an electrolytic cell for use in electrowinning metal values from solutions containing same, which comprises a housing arranged to contain solution to be subjected to electrolysis, anode means, cathode means, inlet means for feeding fresh solution into the housing and outlet means for removing treated solution from the cell, wherein the cathode means comprises an assembly which contains a material on which electrowon metal is deposited and which assembly is arranged to be removed from the cell for removal of the material bearing deposited metal values and replacement by fresh material, and subsequent return of the cathode assembly to the cell.

The present invention will now be described, by way of example, with reference to the accompanying drawings, in which.

Figure 1:
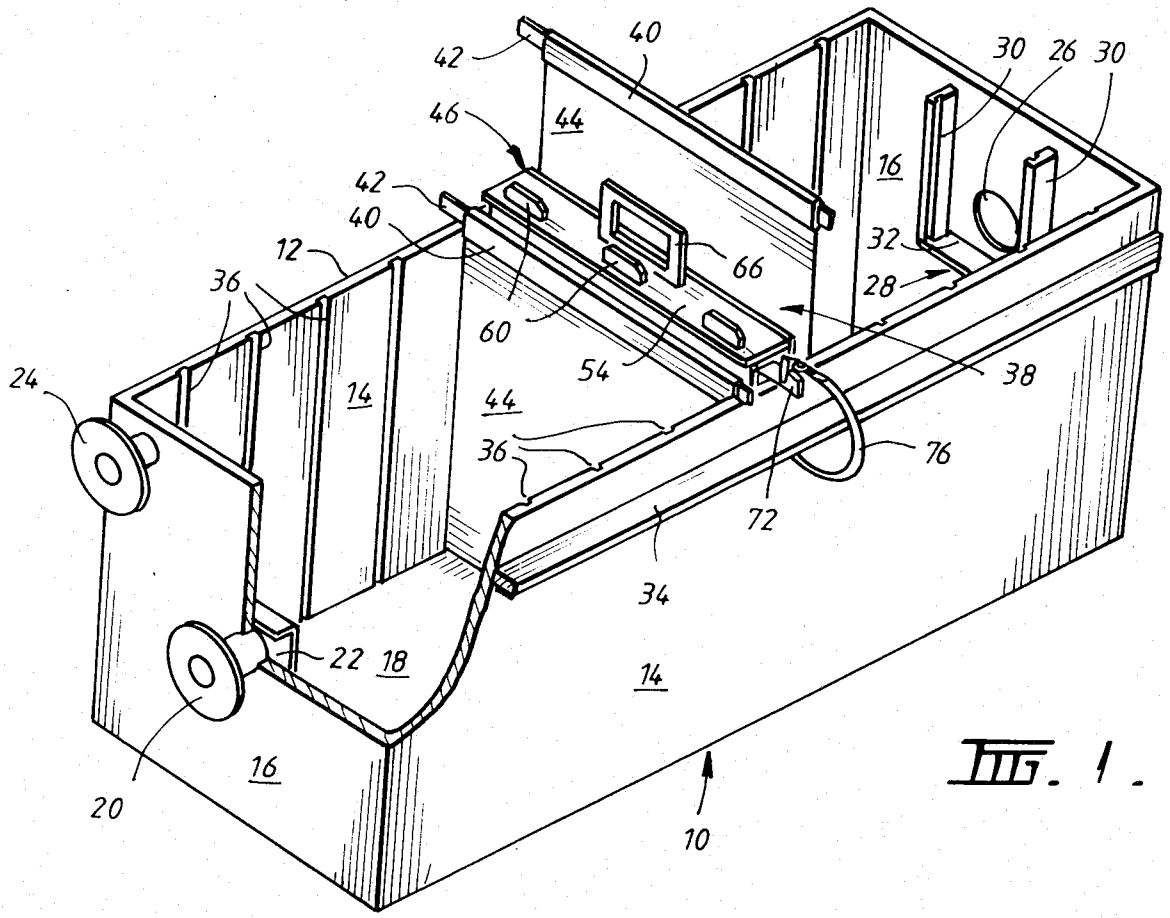
FIG. 1 is an upper perspective, partially broken away view of an electrolytic cell in accordance with the present invention.

In FIG. 1 of the accompanying drawings, there is shown an electrolytic cell 10 comprising an open topped housing 12 which comprises a pair of opposed side walls 14, a pair of opposed end walls 16 and a base 18. The housing 12 comprises an inlet feed pipe 20 in a first end wall 16. As can be seen in FIG. 1, a deflector plate 22 is mounted in the housing 12 adjacent the feed pipe 20 to deflect incoming liquid and ensure an even distribution thereof in the cell 10. The first end wall 16 also comprises an overflow 24. The overflow 24 is particularly envisaged for use when metal becomes deposited in the cell 10 as will be described, and there is a resulting rise in the liquid level.

A second end wall 16 opposite the first end wall 16 contains an outlet aperture 26 through which treated liquid flows to leave the cell 10. A framework 28 is mounted about the aperture 26. The framework 28 includes a pair of opposed, spaced vertical members 30 with longitudinally extending slots on their opposed faces, and a shelf 32. The framework 28 is arranged to receive weir plates (not shown) which are engaged at their lateral edges with the slots of the members 30 lowered until they rest on the shelf 32. The weir plates are arranged to determine the liquid level in the cell 10 during operation.

Each side wall 14 is provided adjacent its upper end on the outside of the cell 10 with a horizontally extending electrical conductor bar 34. The conductor bar 34 on the side wall 14 which can be seen in FIG. 1 is arranged to be connected to the cathodic side of the cell 10. A further conductor bar 34 which cannot be seen in the drawings is mounted on the external face of the other side wall 14 and is arranged to be connected to the anodic side of the cell 10.

As can be seen in FIG. 1, each side wall 14 has formed on its inner face a plurality of spaced substantially vertical grooves 36. Each groove 36 in a wall 14 has a corresponding opposed groove 36 in the other wall 14.

Further, the cell 10 comprises anode assemblies 38. Each anode assembly 38 comprises an upper horizontal beam 40 which has a copper or other electrically conductive material bar 42 extending longitudinally through it and extending beyond each of its ends. Each anode assembly 38 further comprises a sheet of electrically conductive material 44. The sheet 44 is in electrically conductive relationship with the bar 42 and is suspended from the beam 40. Further, the anode assemblies 38 are inserted in the cell 10 by having the lateral edges of the sheet 44 engaged with opposed pairs of grooves 36 and then lowered into the housing 12 until the ends of the bar 42 rest on the upper edges of the side walls 14. The sheets 44 may be formed of stainless steel mesh.

Figure 2:
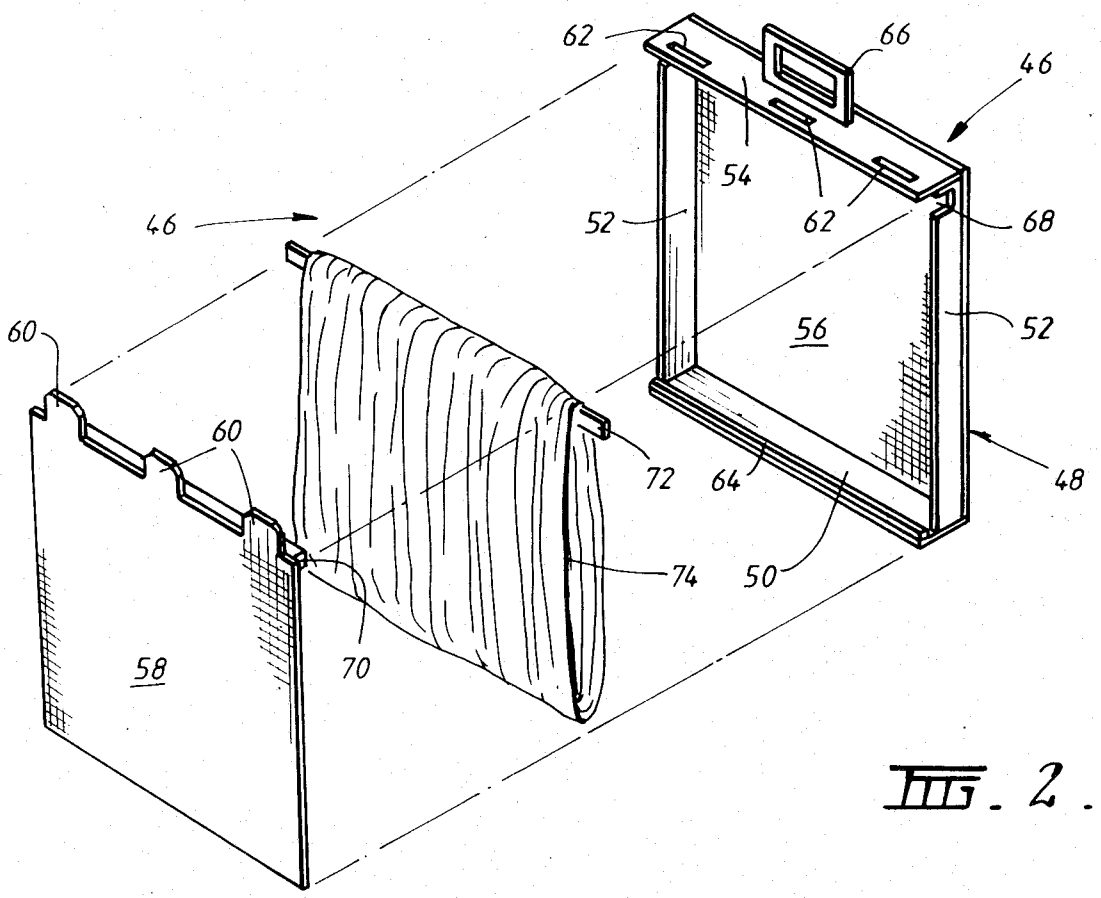
FIG. 2 is a schematic, exploded view of a cathode assembly of the electrolytic cell of FIG. 1.

The bars 42 are always located above liquid level. An anode assembly is, in use, placed in each pair of opposed grooves 36 so that the cells 10 contain a plurality of the anode assemblies 38 at regular, spaced intervals. A cathode assembly 46 is lowered into the space between each adjacent pair of anode assemblies 38. As can be seen in FIG. 2, each cathode assembly 46 comprises a box 48 comprising an elongated base 50, a pair of narrow side walls 52 extending upwardly from the base 50 and an elongated roof 54 extending across the upper ends of the side walls 52.

A first apertured end wall 56 is mounted across the gap formed by the base 50, the side walls 52 and the roof 54 at the side thereof towards the outlet 26. The wall 56 is typically formed of a non-conductive mesh material and is fixed in place in the box 48.

A second apertured end wall 58 is, in use, mounted across gap formed by the base 50, the side walls 52 and the roof 54 at the side thereof closest to the inlet 20. The end wall 58 may also be formed of a non-conductive mesh material but, unlike the wall 56, is detachable from the remainder of the box 48.

In this connection, the wall 58 is provided at is upper end with three spaced upwardly projecting ears 60.

Further, the roof 54 projects beyond the walls 52 on the side adjacent the wall 58. Adjacent the projecting edge the roof 54 is provided with a plurality of spaced slots 62 extending in a line and corresponding with respective ears 60.

Furthermore, the base 50 also projects beyond the walls 52 and is provided at the projecting edge with a longitudinally extending stop 64. In use, the wall 58 is inserted in place by inserting the ears 60 into respective slots 62 from below. The ears 60 are of a height such that when they are fully inserted in the slots 62, the lower end of the wall 58 is at a level above the stop 64. When the wall 58 is thus engaged with the roof 54 the wall 58 can be pivoted about the slots 62 until the lower end is inside of the stop 64. Then the wall 58 can be released so that the lower end falls under the influence of gravity behind the stop 64. In this way the lower end of the wall 58 engaees behind the stop 64. The roof 54 is also provided with a handle 66 which facilitates removal of the cathode box 46 from the cell 10 and the placement of the cathode box 46 in the cell 10 between a pair of anode assemblies 38.

Still further, each side wall 52 comprises an open under recess 68 (only one of which can be seen in FIG. 2) adjacent its upper end. The recesses face towards the wall 58. The external parts of each cathode assembly 46 are formed of electrically insulating material. Also, the wall 58 contains on its inner face a horizontally extending batten 70 adjacent the upper end thereof. When the wall 58 is engaged with the box 48, the batten 70 engages with the recesses 68. The cathode assembly 46 still further comprises an electrically conductive bar 72 which is formed of copper or other electrically conductive material. The electrically conductive bar 72 has a length of steel wool 74 wrapped around it and suspended from it in freely hanging manner. The steel wool 74 thus forms a continuous loop suspended from the bar 72. The electrically conductive bar 72 with the steel wool 74 suspended from forms a cathode. The cathode is placed in the cathode box 46 by engaging the ends of the electrically conductive bar 72 with the recesses 68. Thus, the steel wool is suspended from the bar 72 in the box 48. When the wall 58 is put in place the batten 70 presses the steel wool 74 into engagement with the bar 72 to enhance the degree of electrical contact between the bar 72 and the steel wool 74.

The completed cathode assembly 46 is, in use, lowered by means of the handle 66 between adjacent pairs of anode assemblies 38. The cathode assemblies 46 can be provided with non-electrically conductive spacers to ensure that they are adequately spaced from the adjacent anode assemblies 38. Further, the bar 72 of each cathode assembly 46 projects outwardly of the walls 52 and rests on the tops of the side walls 14. The bar 72 is thus above liquid level at all times. When all of the anode assemblies 38 and cathode assemblies 46 are in place in the cell 10, the electrically conductive bars 72 of each cathode assembly are connected to the respective conductor bar 34 by a flexible electrical conduit and clamping means 76 as shown in FIG. 1. Similarly, the electrically conductive bar 42 of each anode assembly 38 is connected by suitable means (not shown) to the other conductive bar on the other side wall 14 of the housing 12.

Further, a liquid having dissolved therein metal values such as gold, is caused to flow through the cell 10 from the inlet 20 and to leave the cell 10 through the outlet 26. The anodes and cathodes are energised by means of electrical current from the bars 34. In known manner, metal values such as gold, in solution in the liquid deposits on the steel wool 74 of the cathode and the solution becomes depleted of the metal values. When the amount of gold deposited on the cathodes 74 has reached a level suitable for recovery, each entire cathode assembly 46 is removed from the cell. The anode assemblies 38 are normally retained in the cell 20 and are not usually removed therefrom. Typically, the cathode assemblies 46 are removed daily and the used steel wool 74 is replaced by fresh steel wool 74. In order to remove a cathode, the wall 58 is removed firstly by lifting it a fraction so that the ears 60 project further through the slots 62 and so that the lower end of the wall 58 clears the stop 64. The lower end of the wall 58 is then pivoted away from the base 50 disengaging the batten 70 from the slots 68, and then the wall 58 is lowered, disengaging the ears 60 from the slots 62 to remove the wall 58 from the cathode box 48.

Then the bar 72 is removed from the recesses 68 together with the steel wool 74 which is loaded with deposited metal. A fresh cathode having steel wool 74 suspended from an electrically conductive bar 72 is placed in the cathode box 48 by engagement of the bar 72 with the recesses 68 as described above. The wall 58 is then replaced by engaging the ears 60 with respective slots 62, then placing the lower end of the wall 58 inside of the stop 64 and then allowing the wall 58 to drop behind the stop 64 under the influence of gravity. The cathode assembly 46 can then be replaced in the cell 10 and made ready for further use while the loaded steel wool cathode 74 is subjected to treatment to recover the deposited metal values.

Figure 3:
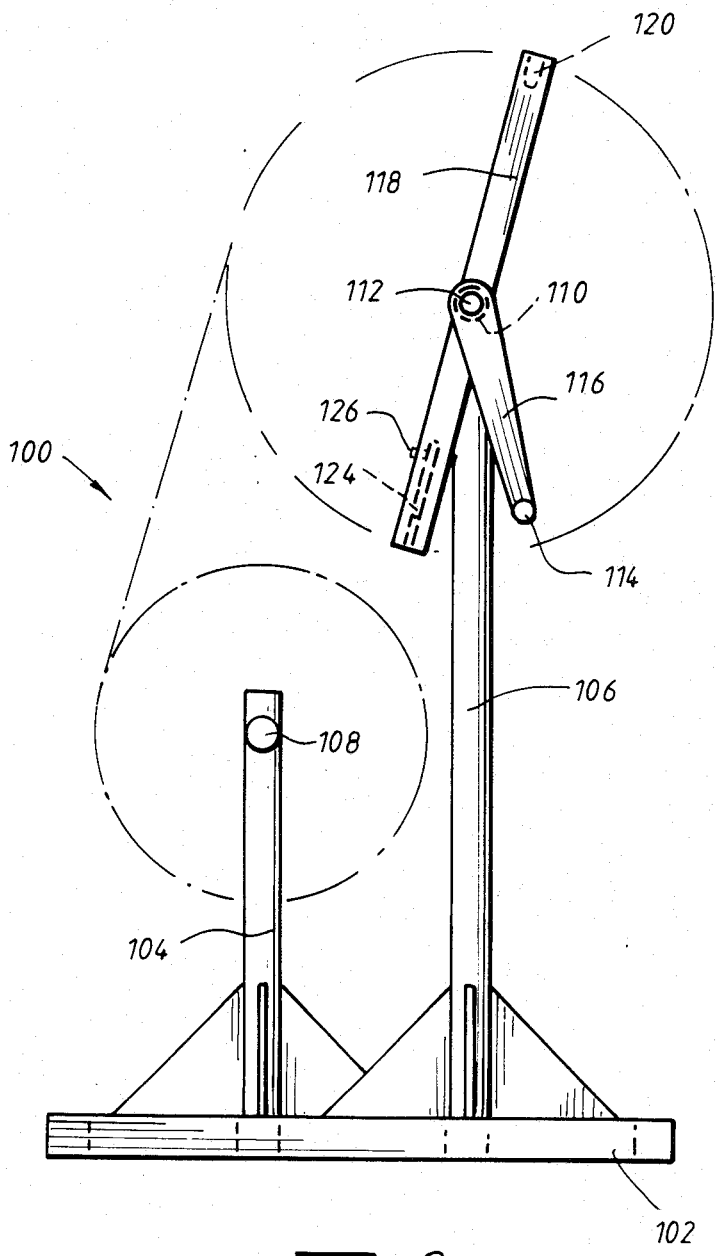
FIG. 3 is a side elevation of a winding apparatus used for forming cathodes used in the cell of the the present invention.
Figure 4:
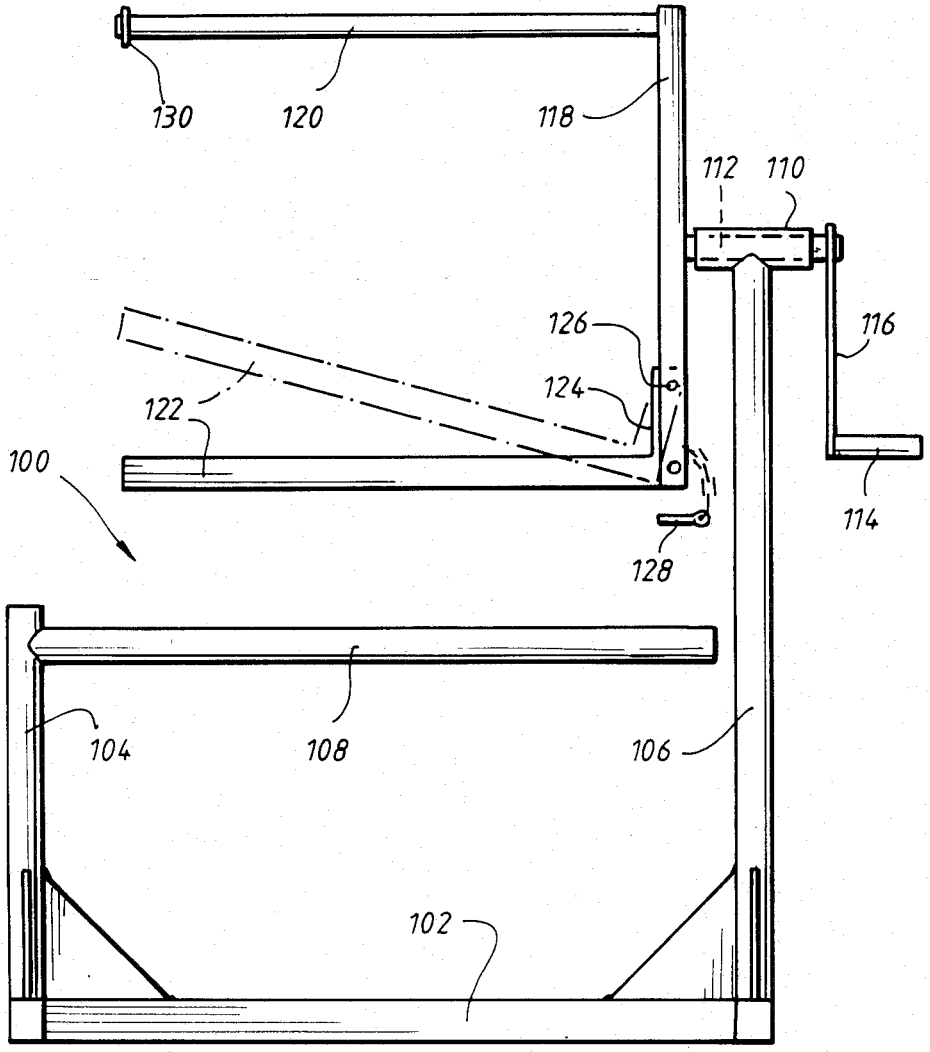
FIG. 4 is a front elevation of the apparatus of FIG. 3.

In FIGS. 3 and 4, there is shown an apparatus 100 for winding steel wool onto copper bars 72 to form the cathodes 74. The apparatus 100 comprises a base 102 having a relatively short upstanding post 104 extending from one edge thereof and a relatively long unstanding post 106 extending from another edge thereof.

The post 104 has a horizontal cantilever rod 108 extending from a point adjacent the upper end of the post 104 across the base 102.

The post 106 is formed at its upper end with a hollow T-piece 110. A shaft 112 is mounted in the T-piece 110. A handle 114 is connected to the shaft 112 by means of a crank 116 in such manner that rotation of the handle 114 causes rotation of the shaft 112. At its end opposite the handle 114, the shaft 112 is connected to the mid point of a tranversely extending pipe 118. A U-shaped bar 120 extends outwardly from one end of the pipe 118 and a second bar 122 extends outwardly from a second end of the pipe 118. The bar 120 is fixed relative to the pipe 118 whilst the bar 122 is hingedly connected to the pipe 118 by means of a short leg 124 which is pivotally connected to the pipe 118 by means of a pin 126.

The bar 122 is arranged to be retained in the position shown in solid lines in FIG. 4 by means of a locking pin 128 engaging in cooperating apertures in the bar 122 and the pipe 118.

In use, a roll of steel wool is mounted on the rod 108 by being passed over the free end thereof as can be seen in FIG. 3. A copper bar 42 or 72 is inserted in the U-shaped bar 120 and is retained in place therein by means of a clip 130. The roll of steel wool is passed over the bars 120 and 122 adjacent one end thereof. Then the handle 114 is rotated so that the shaft 112 is rotated so as to cause rotation of the pipe 118 about its mid point. The bars 120 and 122 describe a circle and pull the steel wool from the roll thereof on the rod 108. The steel wool is taken up in such manner that upon each rotation of the shaft 112 the steel wool overlaps adjacent loops of steel wool but also covers a further extent of the bars 120 and 122. This is continued until the bars 120 and 122 are completely covered. Then the cathode can be removed from the apparatus 100 by releasing the lock pin 128 to enable the bar 122 to pivot to the position shown in dotted lines in FIG. 2 and also by removing the clip 130. Then the bars 42 or 72 and steel wool loop can be readily removed by being slid off the bar 120 and are immediately available for use. Once this is done the apparatus 100 can be made ready for further use by returning the bar 122 to its original position and re-engaging the lock pin 128 and by placing a fresh bar 42 or 72 in place and by replacing the clip 130. Modifications and variations such as would be apparent to a skilled addressee are deemed within the scope of the present invention.

I claim:

1. An electrolytic cell for use in electrowinning metal values from solutions containing same, which comprises a housing arranged to contain a predetermined level of solution to be subjected to electrolysis, anode means, cathode means, inlet means for feeding fresh solution into the housing and outlet means for removing treated solution from the cell, wherein the cathode means comprises a cathode assembly which contains material upon which electrowon metal values are deposited and which cathode assembly is arranged to be removed from the cell for removal of the material bearing deposited metal values and replacement by fresh material, and subsequent return of the cathode assembly to the cell, said cathode assembly further comprising a liquid pervious box with a detachable wall which when detached enables removal and replacement of cathode material, a cathode comprising an electrically conductive bar located above said predetermined level, from which is suspended a loop of electrically conductive material on which, in use, the metal values are deposited, and a pair of opposed recesses arranged to receive said electrically conductive bar, said detachable wall being provided with a batten which engages with the recesses when the detachable wall is secured in place in the box so as to press the electrically conductive cathode material into engagement with the electrically conductive bar.

2. An electrolytic cell according to claim 1, in which the detachable wall is arranged to be engaged with the box by means of one or more ears engaging with a respective slot or slots in the box.

3. An electrolytic cell according to claim 1, in which the detachable wall is arranged to be engaged with the box by means of one or more ears engaging with a respective slot or slots in the box and in which the ears are at the top of the detachable wall, and when the ears and slots are in engagement the detachable wall is arranged to be allowed to fall under the influence of gravity behind a stop at the lower end of the cathode box.

4. An electrolytic cell according to claim 1, in which ends of the electrically conductive bar project outwardly of the box and, in use, engage with upper edges of side walls of the cell so as to suspend the cathode assembly in place in the cell.

5. An electrolytic cell according to claim 1, in which the cell has side walls with internal faces formed with parallel, spaced substantially vertical grooves, wherein each groove in a side has a corresponding opposed groove in the other side, each pair of opposed grooves being arranged to receive slidably an anodic sheet of an anode assembly such that, in use, the cell comprises a plurality of spaced anode assemblies with spaces between them arranged to receive cathode assemblies.

6. An electrolytic cell according to claim 5, in which each anode assembly comprises an upper electrically conductive bar located above said predetermined level, from which the anodic sheet is suspended.

7. An electrolytic cell according to claim 5, in which the electrically conductive bar extends laterally beyond the anodic sheet and the lateral extensions of the bar rest on upper ends of sides of the cell so as to suspend the anode assemblies.

8. A liquid pervious electrode assembly arranged to be mounted in a liquid containing electrolytic cell, comprising a box having a detachable wall, and, within said box an electrode comprising an electrically conductive bar from which is suspended a loop of electrically conductive material, a pair of opposed recesses adjacent an upper end of the liquid pervious box said recesses being arranged to receive the electrically conductive bar, the detachable wall being provided with a batten which engages with the recesses of the box when the detachable wall is secured in place in the electrode box so as to press the electrically conductive electrode material into engagemtnt with the electrically conductive bar, said detachable wall, when detached, enabling reemoval and replacement of said electrically conductive material.

9. A liquid pervious electrode assembly according to claim 8, in which the detachable wall is arranged to be engaged with the box by means of one or more ears engaging with a respective slot or slots in the box.

10. A liquid pervious electrode assembly according to claim 8, in which the detachable wall is arranged to be engaged with the box by means of one or more ears engaging with a respective slot or slots in the box and in which the ears are at the top of the detachable wall, and when the ears and slots are in engagement, the detachable wall is arranged to be allowed to fall under the influence of gravity behind a stop at the lower end of the electrode box.

11. A liquid pervious electrode assembly according to claim 8, in which ends of the electrically conductive bar project outwardly of the box.

* * * * *